United States Patent [19]

Strom et al.

[11] Patent Number: 4,515,663

[45] Date of Patent: May 7, 1985

[54] ACID ZINC AND ZINC ALLOY ELECTROPLATING SOLUTION AND PROCESS

[75] Inventors: Alice M. Strom, Warren; R. Wilbur Herr, Troy; Sylvia Martin, Utica, all of Mich.

[73] Assignee: OMI International Corporation, Warren, Mich.

[21] Appl. No.: 568,361

[22] Filed: Jan. 9, 1984

[51] Int. Cl.[3] ..... C25D 3/22; C25D 3/56

[52] U.S. Cl. ..... 204/44.2; 204/55 R

[58] Field of Search ..... 204/43 Z, 55 R, 43 T, 204/114, 123, 44.2

[56] References Cited

U.S. PATENT DOCUMENTS 3,017,334 1/1962 Jones ..... 204/55 R 4,170,526 10/1979 Creutz et al. ..... 204/55 R

FOREIGN PATENT DOCUMENTS 13602 12/1971 Japan ..... 204/55 R

*Primary Examiner*—G. L. Kaplan

*Attorney, Agent, or Firm*—Richard P. Mueller

[57] ABSTRACT

An aqueous acid electroplating solution and process for electrodepositing an adherent, ductile zinc, zinc-cobalt, zinc-nickel, zinc-cobalt-nickel alloy deposit on a conductive substrate which contains a comparatively low concentration of boric acid to inhibit formation of bath insoluble polyborate compounds and contains an effective amount of a polyhydroxy additive agent containing at least 3 hydroxyl groups and at least 4 carbon atoms of the structural formula:

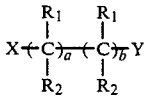

as hereinafter more specifically defined. The electroplating solution further contains conventional acid zinc and zinc alloy bath constituents and supplemental additive agents of the types known in the art.

19 Claims, No Drawings

ACID ZINC AND ZINC ALLOY ELECTROPLATING SOLUTION AND PROCESS

BACKGROUND OF THE INVENTION

The present invention broadly relates to an improved aqueous acidic zinc and alloy electroplating solution and process employing such solution for depositing a corrosion resistant and/or decorative zinc or zinc alloy plating on a variety of conductive substrates including ferrous substrates such as iron and steel. Such aqueous acidic zinc and zinc alloy electrolytes which may be of the chloride as well as the sulfate type in accordance with prior practice conventionally contain substantial amounts of boric acid as an essential ingredient which contributes to the buffering of the bath and also imparts beneficial characteristics to the zinc or zinc alloy electrodeposit. Typically, commercial acid zinc and zinc alloy baths contain a minimum of about 25 grams per liter (g/l) of boric acid and more typically, about 30 to about 35 g/l. The operating pH of such commercial zinc and zinc alloy baths typically ranges from about 4 to about 6 and it is conventional practice to employ soluble zinc anodes for replenishing the zinc ion concentration during an electroplating operation. In a zinc alloy electroplating bath, the alloying metal ions such as nickel and/or cobalt are conventionally replenished by the addition of bath soluble and compatible salts of such alloying ions.

A continuing problem associated with such aqueous acidic zinc and zinc alloy electroplating baths has been the formation of insoluble zinc polyborate compounds which form a coating on the zinc anodes as well as precipitates in the electroplating bath. The tendency toward the formation of such undesirable insoluble polyborate compounds is aggravated as the concentration of boric acid increases, during periods of quiescent standing of the bath such as over weekends and when the temperature of the bath decreases. It is reported that such polyborate compounds contain from about 3 to about 7 molecules of borate and are extremely insoluble such that the buildup of a coating of the polyborate compound on the zinc anodes drastically reduces the conductivity of the bath and the dissolution of the soluble zinc anodes necessitating frequent removal of the zinc anodes and a grinding or scraping of the surfaces thereof to restore the process to satisfactory commercial operation. The necessity of frequently cleaning the zinc anodes constitutes a time consuming, costly and tedious operation and in recognition of this problem, it has been proposed to eliminate boric acid as an ingredient in such acid zinc plating baths. It has been found, however, that the complete elimination of boric acid drastically reduces the range of usable current densities for achieving uniform commercially acceptable zinc or zinc alloy electrodeposits which has detracted from a widespread commercial acceptance of boric acid-free aqueous acidic zinc or zinc alloy electroplating solutions.

The foregoing problem is overcome in accordance with the improved aqueous acidic zinc and zinc alloy electrolyte and process of the present invention whereby the bath can operate at relatively low boric acid concentrations by virtue of the inclusion of a controlled amount of a polyhydroxy additive agent which substantially eliminates or drastically reduces the formation of the bath insoluble polyborate compounds significantly increasing the useful operating life of the bath and the zinc anodes while at the same time providing for decorative bright, ductile zinc and zinc alloy electrodeposits over a broad range of current densities.

SUMMARY OF THE INVENTION

The benefits and advantages of the present invention in accordance with the composition aspects thereof are achieved by an aqueous acidic electroplating solution of the chloride or sulfate-type containing zinc ions at a concentration effective to electrodeposit zinc, or an alloy of zinc and nickel and/or cobalt in which event the electrolyte further contains an effective amount of nickel and/or cobalt ions, boric acid or the bath soluble and compatible salts thereof present in an amount of at least about 2.5 g/l calculated as boric acid up to a level usually less than about 25 g/l which will vary depending upon the specific type of bath composition employed, primary brighteners present in conventional amounts usually up to about 10 g/l, secondary or supplemental brightening agents generally present at concentrations up to about 10 g/l, hydrogen ions present in a concentration to provide a bath pH of from about 1 up to about 6.5, and a bath soluble and compatible polyhydroxy additive agent containing at least 3 hydroxyl groups and at least 4 carbon atoms of the structural formula:

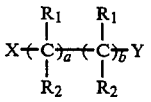

Wherein:

$R_1$ is —H, —$CH_2$—OH, an alkyl group containing 1–4 carbon atoms, a bridging group defined by —$R_3$—;

$R_2$ is —H, —OH, —$CH_2OH$, a bridging group defined by —$R_4$—;

—$R_3$— is —$CH_2$—,

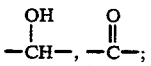

—$R_4$— is —$(CH_2)_c$—, or —$CH_2$—O—$CH_2$—;

X and Y are the same or different and are

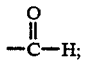

—$NR_5$; —$SO_3H$, an alkyl, alkenyl, alkynyl group containing 1 to 4 carbon atoms; an hydroxy alkyl group containing 1–4 carbon atoms, and hydroxy alkenyl and hydroxy alkynyl group containing 3 to 5 carbon atoms;

$R_5$ is —H, an alkyl, alkenyl, alkynyl, or hydroxy alkyl group containing 1–4 carbons;

a is an integer ranging from 0–6;

b is an integer ranging from 0–6;

c is an integer ranging from 1–5; and a+b is an integer from 1–6;

as well as the compatible bath soluble Group IA and IIA, zinc and ammonium salts thereof and mixtures thereof.

The polyhydroxy additive agent is conventionally employed in amounts of about 3 up to about 30 g/l in consideration of the concentration of boric acid present as well as other constituents in the bath.

In accordance with the process aspects of the present invention, a bright, ductile and adherent zinc or zinc alloy coating is deposited on a conductive substrate employing the aforementioned aqueous acidic zinc or zinc alloy electroplating solution which is controlled at a temperature ranging from about 60° up to about 180° F. and can be operated at a current density ranging from about 1 up to about 300 amperes per square foot (ASF) depending upon the specific type and composition of the electrolyte.

Additional benefits and advantages of the present invention will become apparent upon a reading of the Description of the Preferred Embodiments taken in conjunction with the specific examples provided.

DESCRIPTION OF THE PREFERRED EMBODIMENTS

The aqueous acidic non-cyanide zinc or zinc alloy electroplating bath in accordance with the composition aspects of the present invention contains zinc ions present in an amount effective to electrodeposit zinc from the electrolyte, and may broadly range from about 5 g/l up to saturation in the solution at the particular operating bath temperature which, for example, is about 300 g/l zinc ions and higher at bath temperatures of about 100° F. and above. Typically, in acid chloride solutions of the sodium chloride, potassium chloride or ammonium chloride types, the zinc ion concentration is conventionally controlled within a range of about 7 up to about 50 g/l. In acid sulfate electroplating solutions, the zinc ion concentration is generally controlled within a range of about 30 up to about 110 g/l. Accordingly, depending upon the specific bath composition and temperature, zinc ions can broadly range from about 5 g/l up to saturation and preferably from about 5 up to about 110 g/l.

When a zinc alloy electrodeposit is desired, the aqueous acidic electroplating bath further contains an effective amount of alloying metal ions selected from the group consisting of nickel, cobalt and mixtures thereof present in a concentration to provide the desired percentage of alloying metal or metals in the deposit. When a zinc-cobalt alloy deposit is desired, the alloy will generally contain from about 0.05 percent up to about 5 percent by weight cobalt with the balance zinc. When a zinc-nickel alloy deposit is desired, the alloy will generally contain about 0.05 percent up to about 20 percent by weight nickel with the balance zinc. Zinc-nickel-cobalt alloy electrodeposits can be obtained containing nickel and cobalt within the aforementioned concentrations and in which the ratio of nickel to cobalt in the electrodeposit can be varied to achieve the desired properties.

An aqueous acidic electrolyte suitable for depositing a zinc-nickel alloy contains from about 1 up to about 60 g/l of nickel ions introduced in the form of a bath soluble and compatible nickel salt. An electrolyte suitable for depositing a zinc-cobalt alloy contains about 1 to about 40 g/l of cobalt ions introduced in the form of a bath soluble and compatible salt. For acid chloride-type electrolytes, the concentration of cobalt ions is preferably controlled within a range of about 2 to about 15 g/l while the concentration of nickel ions in such acid chloride-type electrolytes is preferably controlled within a range of about 5 to about 25 g/l. In acid chloride-type baths, the nickel and/or cobalt ions are typically introduced in the form of chloride salts whereas in acid sulfate-type baths, the corresponding sulfate salts are employed. A replenishment of the nickel and/or cobalt ions during operation of the bath is performed by the addition of the appropriate salts of these metals to maintain their concentration within the desired ranges.

The acid chloride-type electrolytes conventionally include inert salts to increase the conductivity of the solution and are usually employed in amounts of about 20 up to about 450 g/l. The inert salts conveniently comprise magnesium and alkali metal chlorides in which the term "alkali metal" is employed in its broad sense to also include ammonium chloride as well as the specific alkali metals such as sodium, potassium, and lithium. Typically, the conductivity salts comprise sodium chloride or potassium chloride.

A further essential ingredient of the electrolyte comprises boric acid as well as the bath soluble and compatible salts thereof which is present in an amount of at least about 2.5 g/l up to a concentration of preferably below about 25 g/l. While concentrations of boric acid in excess of about 25 g/l are not harmful to the zinc electrodeposit, such higher concentrations are undesirable due to the formation of zinc polyborates. Because of the tendency of higher concentrations of boric acid to form polyborates even in the presence of the polyhydroxy additive agent of the present invention, it is preferred to maintain the boric acid concentration at a maximum level of about 15 g/l and preferably at a level below about 10 g/l. In spite of the reduced concentration of the boric acid constituent in the bath in comparison to conventional prior art practices in which boric acid is usually employed in amounts of about 30 up to about 40 g/l, the relatively low concentration of boric acid still enables the attainment of the desired bright, ductile and adherent zinc or zinc alloy deposits even in high current density areas and enables use of the electrolyte over a broad range of operating current densities.

The zinc or zinc alloy electrolyte further contains hydrogen ions in an amount to provide a pH ranging from about 1 up to about 6.5. In acid chloride-type electrolytes, the hydrogen ion concentration is preferably controlled so as to provide a pH of about 4.5 up to about 6.2 while in the acid sulfate-type electrolytes, the hydrogen ion concentration is preferably controlled to provide a pH ranging from about 3.5 up to about 5.2.

In accordance with conventional practice, the aqueous acidic non-cyanide zinc or zinc alloy electrolyte contains a primary brightener or combination of primary brightening agents of any of the types well-known in the art such as those disclosed in U.S. Pat. Nos. 4,170,526, 4,207,150, 4,176,017, and 4,070,256, the teachings of which are incorporated herein by reference. A particularly satisfactory class of primary brightening agents suitable for use in the practice of the present invention is that described in U.S. Pat. No. 4,252,619 including the specific compounds as set forth in Table 1 thereof. The primary brightening agent is conventionally employed in concentrations ranging from about 0.001 up to about 10 g/l with concentrations of about 0.01 up to about 5 g/l being preferred.

Optionally, but preferably, the aqueous electrolyte further contains supplemental or secondary brightening agents of the types conventionally employed in acid chloride and acid sulfate non-cyanide electrolytes. Such supplemental brightening agents may be of any of the types well-known in the art and are usually employed in amounts up to about 10 g/l while amounts of about 0.2 up to about 5 g/l are usually preferred. Typical of secondary brightening agents that can be satisfactorily used in acid chloride-type electrolytes are polyethers, aromatic carboxylic acids and their salts, nicotinate quaternary compounds, aliphatic or aromatic aldehydes or ketones, or the like. For acid sulfate-type electrolytes, typical secondary brighteners that can be satisfactorily employed include polyacrylamides, thioureas, nicotinate quaternaries, or the like. Such supporting brighteners when used are generally employed in the form of a mixture of two or more in combination with a primary brightening agent to achieve the desired brightness of the electrodeposit.

In addition to the foregoing bath constituents, the electrolyte of the present invention further contains a controlled amount of the polyhydroxy additive agent effective to achieve a zinc or zinc alloy electrodeposit of the desired quality and properties in the presence of a lower concentration of boric acid thereby eliminating or signficantly reducing the formation of insoluble polyborate precipitates. The polyhydroxy additive agent comprises a bath soluble and compatible compound containing at least 3 hydroxy groups and at least 4 carbon atoms of the structural formula:

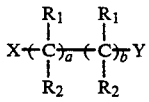

Wherein:

$R_1$ is —H, —$CH_2$—OH, an alkyl group containing 1–4 carbon atoms, a bridging group defined by —$R_3$—;

$R_2$ is —H, —OH, —$CH_2OH$, a bridging group defined by —$R_4$—;

—$R_3$— is —$CH_2$—,

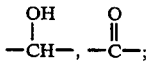

—$R_4$— is —$(CH_2)_c$—, or —$CH_2$—O—$CH_2$—;

X and Y are the same or different and are

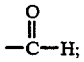

—$NR_5$; —$SO_3H$, an alkyl, alkenyl, alkynyl group containing 1 to 4 carbon atoms; an hydroxy alkyl group containing 1–4 carbon atoms, and hydroxy alkenyl and hydroxy alkynyl group containing 3 to 5 carbon atoms;

$R_5$ is —H, an alkyl, alkenyl, alkynyl, or hydroxy alkyl group containing 1–4 carbons;

a is an integer ranging from 0–6;

b is an integer ranging from 0–6;

c is an integer ranging from 1–5; and a+b is an integer from 1–6;

as well as the compatible bath soluble Group IA and IIA, zinc and ammonium salts thereof and mixtures thereof.

The polyhydroxy additive agent is employed at a concentration in consideration of the concentration of boric acid present as well as the other bath constituents and is generally employed in amounts ranging from about 3 up to about 30 g/l with concentrations of about 5 to about 15 g/l being preferred. While concentrations of the polyhydroxy additive agent above 30 g/l can also be satisfactorily employed, such higher concentrations are commercially undesirable for economic considerations. The specific concentration of the additive agent will vary somewhat depending upon the particular molecular weight of the specific compound or mixtures of compounds employed and the functionality of the compounds used.

In accordance with the process aspects of the present invention, the aqueous acid zinc or zinc alloy electrolyte is employed for electrodepositing zinc or an alloy of zinc, nickel and/or cobalt and is controlled at a temperature ranging from about room temperature (60° F.) up to about 120° F. with temperatures of about 65° to about about 90° F. being typical. The electrodeposition of zinc or zinc alloy is performed at a cathode current density ranging from about 1 up to about 300 ASF depending upon the particular plating technique used, the type and configuration of the article being plated, the specific composition of the electrolyte employed and the concentration of the active constituents therein. For example, acid chloride-type electrolytes can be satisfactorily operated at cathode current densities ranging from about 1 up to about 80 ASF while acid sulfate-type electrolytes are generally operated at cathode current densities of about 20 up to about 300 ASF.

In order to further illustrate the improved aqueous non-cyanide acidic zinc or zinc alloy electrolyte of the present invention, the following specific examples are provided. It will be appreciated that the examples are provided for illustrative purposes and are not intended to be limiting of the present invention as herein described and as set forth in the subjoined claims.

EXAMPLE 1

An acid zinc chloride-type electrolyte is prepared containing about 55 g/l zinc chloride, 150 g/l sodium chloride, 7.5 g/l boric acid, 7.5 g/l trimethylol propane as the polyhydroxy additive agent, 2.5 g/l sodium benzoate as a carrier brightener, 4.8 g/l of Surfynol 485 (a nonionic polyether wetting agent and carrier brightener comprising 2,4,7,9-tetra methyl-5-decyne-4,7-diol ethoxylated), 60 mg/l butyl nicotinate dimethyl sulfate quaternary as a supplemental brightener, and hydrochloric acid sufficient to adjust the pH to about 5.

Cleaned bare steel test panels are electroplated employing air agitation in the electrolyte at a temperature of about 75° F. and at a cathode current density of about 30 ASF for periods of 10 minutes up to 30 minutes. The resultant test panels are observed to have an adherent, fully bright, leveled, decorative zinc deposit thereon.

EXAMPLE 2

An aqueous acid chloride-type zinc electrolyte is prepared containing 45 g/l zinc chloride, 200 g/l potassium chloride, 7.5 g/l boric acid, 10 g/l of pentaerythritol as the polyhydroxy additive agent, 10 g/l of ethoxylated Beta-naphthol as a polyether carrier brightener, 17 mg/l of butyl nicotinate methyl tosylate quaternary as a supplemental brightener, 48 mg/l of benzal acetone as a second supplemental brightener, and hydrochloric acid to adjust the pH to about 5.4.

Cleaned, bare steel test panels are plated as previously described in Example 1 employing air agitation in the electrolyte at an average current density of about 45 ASF and at a bath temperature of about 75° F. As in the case of Example 1, the test panels exhibit a fully bright, leveled, decorative zinc electrodeposit.

EXAMPLE 3

An aqueous zinc acid chloride-type electrolyte typifying a low concentration ammonium chloride and low concentration boric acid bath is prepared containing 56 g/l zinc chloride, 135 g/l ammonium chloride, 7.5 g/l boric acid, 7.5 g/l trimethylol propane, 10 g/l Surfynol 485, and 1.2 g/l of sodium benzoate. The pH of the bath is adjusted to about 5 and test panels are plated as described in Example 1 at cathode current densities ranging from about 1 up to 40 ASF producing excellent semi-bright leveled zinc deposits having acceptable appearance in the low current density areas.

EXAMPLE 4

An aqueous acidic zinc chloride-type electrolyte is prepared containing 85 g/l zinc chloride, 125 g/l sodium chloride, 10 g/l boric acid, 0.5 g/l sodium benzoate, 4.8 g/l Surfynol 485, 20 mg/l of butyl nicotinate dimethyl sulfate quaternary, 50 mg/l of benzal acetone and 10 g/l of sorbitol as the polyhydroxy additive agent.

Hull cell test panels are plated in the foregoing electrolyte at a temperature of 70° F. for a plating time of 10 minutes at a cathode current density of 20 amps per square foot. The Hull cell panel was observed to have a bright zinc electrodeposit across the entire current density range of the test panel which was from 3 to 40 ASF.

EXAMPLE 5

An aqueous acidic zinc-nickel alloy electrolyte is prepared containing 70 g/l zinc chloride, 48 g/l nickel chloride hexahydrate, 125 g/l sodium chloride, 15 g/l boric acid, 10 g/l sorbitol, 3 g/l sodium benzoate, 4 g/l sodium acetate, 5 g/l Surfynol 485, 0.2 g/l alkyl naphthalene sulfonate, 0.05 g/l benzylidene acetone, and hydrogen ions to provide a pH of about 5.

The foregoing electrolyte is controlled at a temperature of about 85° F. employing zinc anodes and steel parts are plated in a rotating barrel at an average cathode current density of about 12 ASF. The parts exhibit a bright electrodeposit of a zinc-nickel alloy containing about 0.3 percent nickel.

EXAMPLE 6

An aqueous acid zinc-cobalt-nickel alloy electrolyte is prepared containing 35 g/l zinc chloride, 40 g/l cobalt chloride hexahydrate, 20 g/l nickel chloride, 20 g/l boric acid, 15 g/l trimethylolpropane, 120 g/l sodium chloride, 2.6 g/l sodium salicylate, 4 g/l Surfynol 485, 1 g/l polyoxyethylene (M.W. 2000), 8 mg/l butylnicotinate dimethyl sulfate quaternary, 52 mg/l benzylidene acetone, 0.6 g/l alkyl naphthalene sulfonate and hydrogen ions to provide a pH of about 4.9.

The bath is controlled at a temperature of about 76° F. and parts are plated in a rotating barrel providing an average cathode current density of about 7 ASF. The parts on inspection have a bright alloy electrodeposit which upon analysis contain 0.7 percent cobalt, 0.6 percent nickel and the balance essentially zinc.

EXAMPLE 7

An aqueous acid zinc-cobalt alloy electrolyte is prepared containing 110 g/l zinc chloride, 40 g/l cobalt chloride hexahydrate, 130 g/l sodium chloride, 10 g/l boric acid, 16 g/l pentaerythritol, 1.6 g/l benzoic acid, 4.5 g/l Surfynol 485, 50 mg/l 4-phenyl 4-sulfo butane-2-one, 60 mg/l 4-phenyl-3-buten-2-one, 10 mg/l butyl nicotinate methyl tosylate quaternary and hydrogen ions to provide a pH of about 5.2.

The bath is controlled at a temperature of 75° F. and is provided with air agitation. Parts are plated while supported on a work rack at an average cathode current density of about 20 ASF. The parts are inspected and possess a fully bright electrodeposit which upon analysis contains 0.6 percent by weight cobalt and the balance essentially zinc.

EXAMPLE 8

An aqueous acid zinc-nickel alloy electrolyte is prepared containing 100 g/l zinc sulfate monohydrate, 75 g/l nickel sulfate hexahydrate, 15 g/l ammonium sulfate, 15 g/l boric acid, 7.5 g/l trimethylol propane, 1.5 g/l polyacrylamide (M.W. 15,000), 0.3 g/l thiourea and hydrogen ions to provide a pH of about 4.2.

The electrolyte was controlled at a temperature of about 85° F. and turbulence was provided to the bath by flow agitation. Conduit parts are plated at an average cathode current density of about 250 ASF and upon inspection were provided with a semi-bright zinc-nickel alloy electrodeposit containing about 2.5 percent nickel and the balance essentially zinc.

EXAMPLE 9

An aqueous acid sulfate-type zinc electrolyte is prepared containing 200 g/l zinc sulfate monohydrate, 20 g/l ammonium sulfate, 10 g/l boric acid, 10 g/l trimethylol propane, 0.05 g/l polyacrylamide (M.W. 1,000,000), 0.15 g/l allylthiourea and hydrogen ions to provide a pH of about 4.

The foregoing electrolyte is controlled at a temperature of about 95° F. for electroplating wire traveling at 100 feet per minute employing solution counterflow as agitation. The wire had a fully bright and ductile zinc deposit thereon.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. An aqueous acid electroplating solution containing zinc ions in an amount effective to electrodeposit zinc, and optionally cobalt and/or nickel ions in an amount effective to electrodeposit a zinc-cobalt, zinc-nickel, and zinc-cobalt-nickel alloy; boric acid and the bath soluble compatible salts thereof present in an amount of about 2.5 g/l to 25 g/l calculated as boric acid, hydrogen ions present inn an amount to provide a pH on the acid side, and a bath soluble and compatible polyhydroxy additive agent containing at least 3 hydroxyl groups and at least 4 carbon atoms of the structural formula:

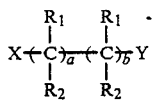

Wherein:

$R_1$ is —H, —$CH_2$—OH, an alkyl group containing 1–4 carbon atoms, a bridging group defined by —$R_3$—;

$R_2$ is —H, —OH, —$CH_2OH$, a bridging group defined by —$R_4$—;

—$R_3$— is —$CH_2$—, $$-\overset{OH}{\overset{|}{CH}}-,\ -\overset{O}{\overset{\|}{C}}-;$$

—$R_4$— is —$(CH_2)_c$—, or —$CH_2$—O—$CH_2$—;

X and Y are the same or different and are

—$NR_5$; —$SO_3H$, an alkyl, alkenyl, alkynyl group containing 1 to 4 carbon atoms; an hydroxy alkyl group containing 1–4 carbon atoms, and hydroxy alkenyl and hydroxy alkynyl group containing 3 to 5 carbon atoms;

$R_5$ is —H, an alkyl, alkenyl, alkynyl, or hydroxy alkyl group containing 1–4 carbons;

a is an integer ranging from 0–6;

b is an integer ranging from 0–6;

c is an integer ranging from 1–5; and a+b is an integer from 1–6;

as well as the compatible bath soluble Group IA and IIA, zinc and ammonium salts thereof and mixtures thereof.

2. The acid electroplating solution as defined in claim 1 in which said polyhydroxy additive agent is present in an amount of at least about 3 g/l.

3. The acid electroplating solution as defined in claim 1 in which said polyhydroxy additive agent is present in an amount up to about 30 g/l.

4. The acid electroplating solution as defined in claim 1 in which said polyhydroxy additive agent is present in an amount of about 5 to about 15 g/l.

5. The acid electroplating solution as defined in claim 1 in which said zinc ions are present in an amount of about 5 g/l up to saturation.

6. The acid electroplating solution as defined in claim 1 in which said zinc ions are present in an amount of about 5 to about 110 g/l.

7. The acid electroplating solution as defined in claim 1 in which said boric acid and salts thereof are present in an amount up to about 15 g/l.

8. The acid electroplating solution as defined in claim 1 in which said boric acid and salts thereof are present in an amount up to about 10 g/l.

9. The acid electroplating solution as defined in claim 1 in which said hydrogen ions are present in an amount to provide a pH of about 1 to about 6.5.

10. The acid electroplating solution as defined in claim 1 which is of the acid chloride-type and said hydrogen ions are present in an amount to provide a pH of about 4.5 to about 6.2.

11. The acid electroplating solution as defined in claim 1 which is of the acid sulfate-type and said hydrogen ions are present in an amount to provide a pH of about 3.5 to about 5.2.

12. The acid electroplating solution as defined in claim 1 further including a primary brightening agent present in an amount of about 0.001 to about 10 g/l.

13. The acid electroplating solution as defined in claim 1 further including a primary brightening agent present in an amount of about 0.01 to about 5 g/l.

14. The acid electroplating solution as defined in claim 1 further including at least one supplemental brightening agent present in an amount up to about 10 g/l.

15. The acid electroplating solution as defined in claim 1 further including at least one supplemental brightening agent present in an amount 0.2 to 5 g/l.

16. The acid electroplating solution as defined in claim 1 further including bath soluble and compatible conductivity salts present in an amount up to about 450 g/l.

17. The acid electroplating solution as defined in claim 1 in which said cobalt ions are present in an amount of about 1 to about 40 g/l.

18. The acid electroplating solution as defined in claim 1 in which said nickel ions are present in an amount of about 1 to 60 g/l.

19. A process for electrodepositing zinc or an alloy of zinc containing nickel and/or cobalt on a conductive substrate which comprises the steps electrodepositing zinc or an alloy of zinc containing nickel and/or cobalt from an aqueous acid electroplating solution as defined in claim 1 for a period of time to deposit zinc or an alloy of zinc of the desired thickness thereon.

* * * * *